US005612160A

United States Patent [19]

Inoue et al.

[11] Patent Number: 5,612,160

[45] Date of Patent: Mar. 18, 1997

[54] ELECTROSTATIC CHARGE DEVELOPING TONER COMPOSITION AND IMAGE-FORMING PROCESS

[75] Inventors: Satoshi Inoue; Chiaki Suzuki; Tetsu Torigoe; Shuji Sato; Takahisa Fujii, all of Minami-ashigara, Japan

[73] Assignee: Fuji Xerox Co., Ltd., Tokyo, Japan

[21] Appl. No.: 523,136

[22] Filed: Sep. 5, 1995

[30] Foreign Application Priority Data

Sep. 12, 1994 [JP] Japan ..... 6-242419

[51] Int. Cl.[6] ..... G03G 9/097

[52] U.S. Cl. ..... 430/110; 430/124

[58] Field of Search ..... 430/110, 125, 430/124

[56] References Cited

U.S. PATENT DOCUMENTS

| | | | |
|---|---|---|---|
| 4,994,340 | 2/1991 | Yamazaki et al. | 430/110 |
| 5,106,715 | 4/1992 | Matsumura et al. | 430/110 |
| 5,171,654 | 12/1992 | Yamazaki et al. | 430/110 |
| 5,244,765 | 9/1993 | Katoh et al. | 430/110 |
| 5,456,990 | 10/1995 | Takagi et al. | 430/110 |

FOREIGN PATENT DOCUMENTS 2-87159 3/1990 Japan .

6-89044 3/1994 Japan .

OTHER PUBLICATIONS

Borsenberger, Paul M. & David S. Weiss. Organic Photoreceptors for Imaging Systems. New York: Marcel–Dekker, Inc. pp. 6–17. 1993.

Diamond, Arthur S., editor. Handbook of Imaging Materials. New York: Marcel–Dekker, Inc. pp. 169–170. 1991.

English Abstract of JP 6–89044. Jun. 1994.

Translation of JP 6–89044. Mar. 1994.

*Primary Examiner*—Christopher D. Rodee

*Attorney, Agent, or Firm*—Oliff & Berridge

[57] ABSTRACT

An electrostatic charge developing toner composition comprising (i) toner particles containing a low-molecular weight polypropylene wax and/or a low-molecular weight polyethylene wax, having a volume average particle size of from 4 to 9 μm, and an exposed amount (X% by weight) of the wax on the surface of the toner in the range of $40 \leqq X \leqq 65$, and (ii) abrasive fine particles having an average particle size of from 0.5 to 5.5 μm, and an image-forming process using the toner.

By the toner composition, the occurrence of filming with the wax in the toner particles is prevented and images excellent in the development stability with the passage of time can be formed.

11 Claims, No Drawings

ELECTROSTATIC CHARGE DEVELOPING TONER COMPOSITION AND IMAGE-FORMING PROCESS

FIELD OF THE INVENTION

The present invention relates to an electrostatic charge developing toner composition being used for a copying machine, a printer, etc., utilizing an electrophotographic technique and also to an image-forming process using the toner composition. In particular, the invention relates to an electrostatic charge developing toner composition capable of restraining the occurrence of filming and obtaining an excellent image stability and to an image-forming process using it.

BACKGROUND OF THE INVENTION

As dry developing processes in various electrostatic copying systems practically used at present, there are a one-component developing system using a toner containing a magnetic substance in the inside of the toner and a two-component developing system using a toner and a carrier such as an iron powder, etc.

In the case of the one-component developing system using a magnetic toner, since an automatic concentration controlling apparatus, etc., which are used for the developing machine of the two-component developing system are not required, the apparatus becomes compact and also since there is no stain with a carrier, a maintenance such as a carrier exchange is not required. Therefore, the one-component developing system has been used not only for small-sized copying machines and printers of a low speed but also for copying machines, printers, and plotters of an intermediate speed or higher and the further improvement of the performance thereof has been expected.

Recently, a digital system has been developed not only for a printer but also for a copying machine, it becomes possible to form latent images more high precisely and to express a delicate gradation by small characters and dots. In particular, a more small-sized apparatus utilizing the one-component developing system has been developed on a plotter for large-sized drawings and it has become possible to more faithfully and decisively reproduce the thickness of the lines of the drawings by a digital system to form high-precise latent images. However, the technique of obtaining images of a high image quality by developing the high-precise latent images thus formed has not yet been sufficiently realized.

As described above, the one-component developing system has various excellent features but has problems to be solved for achieving the high-image quality development. That is, there are problems that the toners are aggregated by the magnetic substance contained in the inside of the toners at development to make coarse the toner, whereby it becomes difficult to faithfully develop latent images, and the fine powder of the unfixed magnetic substance forms from the magnetic toner.

On the other hand, since the two-component developing system has a feature of being easily controlled, etc., because the carrier takes charge of the functions of stirring, transporting, charging, etc., of the developer and in the system, the function as the developer is separated, the two-component developing system has been widely used at present and, in particular, a developer using the carriers coated with a resin is excellent in the charge controlling property and in the case of using the developer, the improvements of the environmental reliance and the stability with the passage of time are relatively easy.

However, with the increase of the demand for small-sizing of the apparatus and energy saving, a toner which can be fixed with a lower energy has been required and for the purpose, a polyolefin wax is added to the one-component magnetic toner and the two-component non-magnetic toner. By the addition of the polyolefin wax, the occurrence of an offset phenomenon that when the toner is applied for a heat roll fixing method, the toner sticks to the heat rolls to stain the successive copies, is prevented, the occurrence of a smudging phenomenon that when after fixing the toner, the toner images formed are rubbed with a white paper, a part of the toner images is broken and transferred onto the white paper, is prevented, and further, the formation of a finger mark which is the phenomenon of destroying the fixed toner images with a finger for releasing the paper after passing the heat rolls is also prevented, thereby the fixing property is improved.

However, although the polyolefin wax-added toner shows a good releasing property from the heat rolls and shows good anti-offset property, there is a fault that polyolefin forms large domains in the resin since the compatibility of polyolefin with a binder resin is low. Thus, the toner is ground at the domain portions at the preparation of the toner, and the wax is liable to expose on the surface of the toner. Also, when the sizes of the toner are reduced for realizing high-quality images, the amount of the wax on the surface of the toner is more increased.

When latent images are developed using such a toner, the wax is transferred onto the developing sleeve and the photoreceptor to cause uneven toner transferring and stains of the photoreceptor, whereby lowering of the density and the deterioration of images occur.

For removing such troubles by the wax, a toner wherein the amount of the wax on the surface of the toner is defined is proposed as described in JP-A-2-87159 (the term "JP-A" as used therein means an "unexamined published Japanese patent application"). However, the toner thus prepared has a problem that the toner is yet insufficient for preventing the occurrences of lowering of the anti-offset property, lowering of the fixing property, etc.

Also, a toner containing two kinds of inorganic fine powders each defined by the molecule weight thereof and the BET surface area is proposed as described in JP-A-6-89044. However, since in the toner, the domains formed by the wax are large and the exposed amount of the wax is large, the toner has a problem that it is difficult to completely restrain the occurrence of filming by the wax although the toner has a polishing effect with the inorganic fine powders.

SUMMARY OF THE INVENTION

The present invention has been made for solving the foregoing problems in the conventional techniques and an object of this invention is to provide as electrostatic charge developing one-component magnetic toner composition and two-component toner composition for obtaining stabilized images by restraining filming of a wax to a developing sleeve and a photoreceptor, and also to an image-forming process using the toner.

Other object of this invention is to provide as electrostatic charge developing one-component magnetic toner composition and two-component toner composition excellent in the dot reproducibility, the fine-line reproducibility, and the gradation capable of faithfully reproducing digital latent images.

Still other object of this invention is to provide an electrostatic charge developing one-component magnetic toner composition and two-component toner composition having a sufficiently wide fixing latitude in the practical use.

Other object of this invention is to provide an image-forming process matching with small-sizing and energy saving in a fixing step.

Also, another object of this invention is to provide an image-forming process capable of forming images excellent in the dot reproducibility, the fine-line reproducibility, and the gradation, and capable of faithfully reproducing digital latent images.

As the result of various investigations for sufficiently widening the fixing latitude in the practical use in the case of using a wax-containing small-sized toner without transferring the wax to electrostatic charge-imparting members such as a developing sleeve, etc., and to a photoreceptor, for attaining the objects described above, the inventors have discovered that by using a low-molecular weight polypropylene wax and/or a low-molecular weight polyethylene wax, defining the exposed amount of the wax on the surface of the toner, and using abrasive particles having particles sizes defined in a specific range, an excellent electrostatic charge developing toner is obtained.

Also, the inventors have discovered an image-forming process using specific heat rollers for a heat-fixing step of toner images together with the electrostatic charge developing toner described above.

That is, according to an aspect of the present invention, there is provided an electrostatic charge developing toner composition comprising (i) toner particles containing a low-molecular weight polypropylene wax and/or a low-molecular weight polyethylene wax, having a volume average particle size of from 4 to 9 μm, and having an exposed amount (X% by weight) of the wax on the surface of the toner in the range of 40% by weight$\leqq$X$\leqq$65% by weight, and (ii) abrasive fine particles having an average particle size of from 0.5 to 5.5 μm.

According to another aspect of the present invention, there is provided an image-forming process comprising a step of forming electrostatic latent images on a latent image carrier, a step of developing the electrostatic latent images with a developer, a step of transferring the toner images formed onto a transfer member, and a step of heat-fixing the toner images on the transfer member, wherein the developer comprises toner particles containing a low-molecular weight polypropylene wax and/or a low-molecular weight polyethylene wax, having a volume average particle size of from 4 to 9 μm, and having an exposed amount (X% by weight) of the wax on the surface of the toner in the range of 40% by weight$\leqq$X$\leqq$65% by weight, and abrasive fine particles having an average particle size of from 0.5 to 5.5 μm are used.

DETAILED DESCRIPTION OF THE INVENTION

Then, the invention is described in detail.

First, the toner composition of this invention is explained.

The toner particles in the toner composition of this invention have a volume average particle size in the range of from 4 to 9 μm and is composed of a magnetic fine powder or a coloring agent and a low-molecular weight polypropylene wax and/or a low-molecular weight polyethylene wax, contained in a binder resin.

As the binder resin which is used for the toner of this invention, known synthetic resins or natural resins can be used. For example, one or more vinyl monomers or copolymers thereof.

As specific vinyl monomers, there are styrene, p-chlorostyrene, vinylnaphthalene, ethylenic unsaturated monoolefins such as ethylene, propylene, butylene, isobutylene, etc.; vinyl esters such as vinyl chloride, vinyl bromide, vinyl fluoride, vinyl acetate, vinyl propionate, vinyl benzoate, vinyl formate, vinyl stearate, vinyl caproate, etc.; ethylenical monocarboxylic acids and the esters thereof, such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, butyl methacrylate, etc.; ethylenical monocarboxylic acid substitution products such as acrylonitrile, methacrylonitrile, acrylamide, etc.; ethylenical carboxylic acids and the esters thereof, such as dimethyl maleate, diethyl maleate, dibutyl maleate, etc.; vinyl ketones such as vinyl methyl ketone, vinyl hexyl ketone, methyl isopropenyl ketone, etc.; vinyl ethers such as vinyl methyl ether, vinyl isobutyl ether, vinyl ethyl ether, etc.; vinylidene halides such as vinylidene chloride, vinylidene chlorofluoride, etc.; N-vinyl compounds such as N-vinylpyrrole, N-vinylcarbazole, N-vinylindole, N-vinylpyrroline, etc.

As the magnetic fine powder being used for the toner of the one-component developing system, the fine powders of known magnetic substances, for example, metals such as iron, cobalt, nickel, etc., and the alloys thereof; metal oxides such as $Fe_3O_4$, $\gamma$-$Fe_2O_3$, cobalt-added iron oxide, etc. and various kinds of ferrites such as MnZn ferrite, NiZn ferrite, etc. can be used and further, the foregoing fine powders which surfaces are treated with a silane coupling agent, a titanate coupling agent, etc., or coated with a polymer may be used.

When the magnetic fine powder is contained in a binder resin, the mixing ratio of the magnetic powder is in the range of preferably from 30 to 70% by weight, and more preferably from 35 to 65% by weight of the total toner particles. If the mixing ratio of the magnetic fine powder is less than 30% by weight, there occur the problems that the binding force of the toner by the magnet of the toner carrier is lowered and the toner particles are scattered. Also, if the mixing ratio is more than 70% by weight, there is a problem that the reproducibility of the density is lowered.

As the coloring agent for use in this invention, any known coloring agents which are conventionally used for toners can be used and for example, carbon black, organic pigments, dyes, etc., can be properly used.

The low-molecular weight polypropylene wax and the low-molecular weight polyethylene wax each having a softening point of from 90° to 160° C. are used in this invention.

In the present invention one of the low-molecular weight polypropylene wax and the low-molecular weight polyethylene wax may be incorporated in the toner particles in this invention but the use of both waxes is preferred. When both waxes are used, there are advantages that the anti-offset property becomes good and further the occurrence of the smudging phenomenon, that is, the phenomenon that when the toner images are rubbed with a white paper after fixing, a part of the toner images is broken and transferred onto the white paper is prevented.

The low-molecular weight polypropylene wax and/or the low-molecular weight polyethylene wax is compounded such that the exposed amount (X% by weight) of the wax(es) on the surfaces of the toner particles is in the range of 40% by weight$\leqq$X$\leqq$65% by weight. In this case, if X is less than 40% by weight, a hot offset, finger marks, etc., occur to lower the fixing property of images, while if X is more than 65% by weight, the transfer of the wax onto a developing sleeve occurs. Accordingly, in this invention, it is necessary to employ the range of 40% by weight≦X≦65% by weight.

As a method of controlling the exposed amount of the wax on the surfaces of the toner particles, there are a method of controlling the addition amount of the wax and the dispersing average diameters of the wax, a post treatment of the toner surfaces, etc. The dispersing average diameter of the wax is required to be in a range of 0.001 to 5 μm, and preferably 0.01–3 μm. When the dispersing average diameter is less than 0.001 μm, anti-offset property is lowered, and when the dispersing average diameter is more than 5 μm, the domain portions of the wax are smashed at the preparation of the toner to increase the amount of the wax on the surfaces of the toner particles. As a method of controlling such dispersing average diameters of the wax, there is, for example, a method of controlling the temperature by kneading the toner. By kneading the toner with the wax at a temperature of not higher than the softening point of the wax, a kneading shear is also applied to the wax portion in a slab, whereby the dispersion of the wax can be reduced to a certain extent. By the post treatment, such as a heat-aeration of 100° C. or more, the exposed amount of the wax on the surface of the toner can be increased.

Also, the toner particles can contain various materials for the purposes of controlling electrostatic charges, controlling the electric resistance, etc. For example, a fluorine series surface active agent, salicylic acid, a chromium series dye such as a chromium complex, etc., a high molecular acid such as a copolymer containing maleic acid as a monomer component, a quaternary ammonium salt, an azine dye, such as niglosine, carbon black, etc., can be added to the toner particles.

The toner particles can be produced by heat-kneading the components described above by an ordinary method and after cooling, grinding and classifying the kneaded mixture and in this case, it is necessary that the particle sizes of the toner particles thus produced are from 4 to 9 μm. If the particle sizes of the toner particles are less than 4 μm, the amount of the wax on the surfaces is increased and the transfer of the wax onto a sleeve is more liable to occur, while if the particle sizes are more than 9 μm, the reproducibility of fine lines of copying images is reduced to be liable to lower the image quality.

On the other hand, the abrasive fine particles, which are added to the toner particles as an external additive, have an average particle size of from 0.5 to 5.5 μm and as the abrasive fine particles, the fine particles of inorganic metal oxides, nitrides, carbides, and sulfuric acid or carbonic acid metal salts each having a Mohs'hardness of at least 3 are used. Specific examples of the abrasive for use in this invention but the invention is not limited to these materials.

That is, there are metal oxides such as $SrTiO_3$, $CeO_2$, CrO, $Al_2O_3$, MgO, $TiO_2$, FeO, $Fe_2O_3$, $Fe_3O_4$, etc.; nitrides such as $Si_3N_4$, etc.; carbides such as SiC, etc.; and sulfuric acid or carbonic acid metal salts, such as $CaSO_4$, $BaSO_4$, $CaCO_3$, etc. Also, the foregoing materials treated with a surface-treating agent such as a silane coupling agent, a titanate coupling agent, etc., or coated with a polymer may be used.

If the average particle size of the abrasive fine particles is less than 0.5 μm, the abrasive effect is low and the toner particles containing the abrasive fine particles cannot scratch off the wax caused filming. Also, if the average particle size is more than 5.5 μm, the abrasive effect is too high, whereby the abrasion of a photoreceptor is accelerated or a developing sleeve is injured to cause uneven transport of the toner particles.

The added amount of the abrasive fine particles is preferably in the range of from 0.1 to 20% by weight, more preferably from 0.15 to 10% by weight and most preferably from 0.15 to 5% by weight of the amount of the toner particles.

To the toner composition of the present invention can be added inorganic fine particles of silica, titania, etc., as an external additive in addition to the abrasive fine particles described above for improving the fluidity or the charging property. The primary particle sizes of the inorganic fine particles are preferably from 5 to 50 nm and the inorganic fine particles the surfaces of which are subjected to a surface treatment such as a hydrophobic treatment, etc., may be used.

The toner composition of the present invention is produced by adding the foregoing abrasive fine particles and other external additives to the toner particles described above and mixing them by a Henschel mixer, etc.

When the toner composition of the present invention is a two-component series toner, the toner particles of the present invention are mixed with a carrier. As the carrier, a magnetic powder dispersed type carrier containing a binder resin and a magnetic powder, or a coat type carrier can be used.

The magnetic powder dispersed type carrier having an average particle size in the range of from 20 to 150 μm and a volume resistivity of from $10^{10}$ to $10^{15}$ Ω·cm is desirable. As the binder resin, the binder resins for the toner particles described above can be used. As the magnetic powder, fine particles of ferromagnetic substances ordinarily used can be used and specific examples thereof include triiron tetraoxide, ferrites, chromium oxide, various kinds of metal powder, etc. Further, if required, a charge controlling agent may be included therein. The magnetic powder is used in a carrier preferably in an amount of 30 to 95% by weight, and more preferably 45 to 90% by weight based on a total carrier.

The magnetic powder dispersed type carrier is prepared by a process comprising kneading the components disclosed above, grinding and classifying, in which the above components may be dissolved in an appropriate solvent or melted by heating, and then subjected to spray drying.

The coat type carrier has a resin coating on a surface of the magnetic core, and preferably has an average particle size of 40 to 200 μm and volume resistivity of $10^8$ to $10^{16}$ Ωcm. As the magnetic core, the fine particles of ferromagnetic substances ordinarily used can be used and specific examples thereof includes ferrites, such as tri-iron tetroxide, γ-iron sesquioxide, MnZn ferrite, NiZn ferrite and chromium oxide.

Also, as the resin for coating these magnetic substance cores, there are polyvinylidene fluoride, a vinylidene fluoride-trifluoroethylene copolymer, a vinylidene fluoride-hexafluoropropylene copolymer, an acrylic acid ester polymer and copolymer, a methacrylic acid ester polymer and copolymer, etc. Such a resin is usually used in the range of from 0.05 to 3.0% by weight of the magnetic substance cores. Coating with the resin can be carried out by an ordinary method. For example, a solution obtained by dissolving the resin in an organic solvent is added to the magnetic substance cores and the magnetic substance cores can be coated with the resin by a fluid coating apparatus.

Then, the image-forming process of the present invention is explained.

The image-forming process of this invention comprises a latent image-forming step of forming a latent image on a latent image holder, a developing step of developing the latent images on the latent image holder, a transfer step of transferring the toner images on the latent image holder onto a transfer member, and a fixing step of heat-fixing the toner images on the transfer member.

For the latent image-forming step, a conventionally known step can be applied. Thus, electrostatic latent images may be formed on the latent image holder such as a photosensitive layer or a dielectric layer by an electrophotographic process or an electrostatic recording process. Then, the latent images formed are visualized with the foregoing electrostatic charge developing toner of this invention in the developing step. The visualized toner images are transferred onto a transfer member such as a paper, etc., by an ordinary method in the transfer step and then heat-fixed in the fixing step.

In the fixing step of the toner images in the present invention, a heat roll is used. For small-sizing the apparatus and improving the fixing property using the small-sized wax-containing toner, it is preferred to use a heat roll having a diameter of from 5 to 30 mm and having a layer containing a filler. If the diameter of the heat roll is less than 5 mm, it is difficult to insert a heater in the inside of the heat roll and if the diameter of the heat roll is more than 30 mm, the fixing system becomes large and it takes a long time to heat the heat roll to a desired temperature. As the filler for the heat roll, it is preferred to use at least one of SiC, CuO, and $Al_2O_3$ each having a high heat conductivity in the layer of the roll in an amount of from 1 to 15% by weight based on a layer containing the filler. As the heat roll containing the filler, specifically, a roll having a layer composed of a perfluoroalkoxy resin (PFA) as the resin having dispersed therein SiC can be used. It is preferred that the surface temperature of the heat roll is maintained at a temperature of from 140° to 240° C.

The particle sizes of the toner particles were measured by a particle size measuring apparatus TA-II having an aperture diameter of 100 μm (manufactured by Coaltar Counter Co.).

The particle sizes of the abrasive fine particles are the average value obtained from the diameters of the abrasive particles measured at random from the photograph of 9,000 magnifications photographed by a transmission type electron microscope.

The amount of the wax on the surfaces of the toner particles is obtained as follows. The ratio of the number of the elements existing in the surface layer (within 5 nm) of a toner particle is determined by ESCA (XPS) [Electron Spectroscopy for Chemical Analysis (X-ray Photoelectron Spectroscopy)], then the ratio of the existing elements of each of the constituting compounds such as the binder resin, the wax, the magnetic powder, etc., which are the toner components is determined, and the amount of the wax existing in the surface layer of the toner is calculated by weight ratio from these values.

The following examples are intended to explain the present invention but not to limit the invention any way.

EXAMPLE 1

| | |
|---|---|
| Styrene-n-Butyl Acrylate Copolymer (copolymerization ratio 80:20) (Mw = 130,000, MI = 14, Tg = 59° C.) | 45.8 wt. parts |
| Magnetic Substance A (hexahedral magnetite, average particle size = 0.19 μm) | 50 wt. parts |
| Negative Charge Controlling Agent (azo series Cr dye) | 0.7 wt. parts |
| Low-Molecular Weight Polypropylene (softening point = 148° C.) | 2.7 wt. parts |
| Low-Molecular Weight Polyethylene (softening point = 126° C.) | 0.5 wt. parts |

The powders of the above materials were mixed by a Henschel mixer and the mixture was heat-kneaded by an extruder kept at 120° C. After cooling, the kneaded mixture was roughly ground and further finely ground to provide a ground product having a 50% volume diameter $D_{50}$ of 6.5 μm. The ground product was classified to provide a classified product having $D_{50}$=7.3 μm and a number distribution of particles having particle sizes of not larger than 5 μm of 30%. In this case, the amount of the waxes on the surface of the toner was 41% by weight. By externally adding 1.0 part by weight of colloidal silica, R972 (trade name, made by Nippon Aerosil Co., Ltd.) and 0.5 parts by weight of cerium oxide A having average particle sizes of 0.7 μm to 100 parts by weight of the toner by a Henschel mixer, a magnetic toner was obtained.

EXAMPLE 2

| | |
|---|---|
| Polyester (bisphenol A type) (Mw = 9,000, Tg = 65° C.) | 48 wt. parts |
| Magnetic Substance B (octahedral magnetite, average particle size = 0.22 μm) | 45 wt. parts |
| Negative Charge Controlling Agent (salicylic acid series Cr dye) | 2.0 wt. parts |
| Low-Molecular Weight Polypropylene (softening point = 153° C.) | 4.0 wt. part |
| Low-Molecular Weight Polyethylene (softening point = 120° C.) | 1.0 wt. part |

The powders of the above materials were mixed by a Henschel mixer and the mixture was heat-kneaded by an extruder kept at 110° C. After cooling, the kneaded mixture was roughly ground and further finely ground to provide a ground product having a 50% volume diameter $D_{50}$ of 7.6 μm. The ground product was further classified to provide a classified product having $D_{50}$=8.5 μm and a number distribution of the particles having particle sizes of not larger than 5 μm of 15%. In this case, the amount of the waxes on the surface of the toner was 64% by weight. By externally adding 0.6 parts of colloidal silica, R972 (trade name, made by Nippon Aerosil Co., Ltd.) and 0.5 parts by weight of strontium oxide A having average particle sizes of 0.5 μm to 100 parts by weight of the toner by a Henschel mixer, a magnetic toner was obtained.

EXAMPLE 3

Using the constituting materials as used in Example 1, the powders of the materials were mixed by a Henschel mixer and the mixture was heat-kneaded by an extruder kept at 80° C. After cooling, the kneaded mixture was roughly ground and further finely ground to provide a ground product having a 50% volume diameter $D_{50}$ of 7.3 μm. The ground product was further classified to a classified product having $D_{50}$=8.0 μm and a number distribution of the particles having particle sizes of not larger than 5 μm of 18%. In this case, the amount of the waxes on the surface of the toner was 30% by weight. By subjecting the classified product to a hot-blast treatment at 200° C., a toner having a surface wax amount of 45% by weight was obtained. By externally adding 1.0 part of colloidal silica, R972 (trade name, made by Nippon Aerosil Co., Ltd.) and 0.5 parts by weight of cerium oxide A having average particle sizes of 0.7 μm to 100 parts by weight of the toner by a Henschel mixer, a magnetic toner was obtained.

EXAMPLE 4

The toner as in Example 1 was used as a classified product and 1.0 part of colloidal silica, R972 (trade name, made by Nippon Aerosil Co., Ltd.) and 0.8 parts by weight of cerium oxide B having average particle sizes of 5 μm were externally added to 100 parts by weight of the toner with a Henschel mixer to obtain a magnetic toner.

Comparative Example 1

The toner as in Example 1 was used as a classified product and 1.0 part of colloidal silica, R972 (trade name, made by Nippon Aerosil Co., Ltd.) and 0.5 parts by weight of strontium oxide B having average particle sizes of 0.3 μm were externally added to 100 parts by weight of the toner with a Henschel mixer to obtain a magnetic toner.

Comparative Example 2

The toner as in Example 1 was used as a classified product and 1.0 part of colloidal silica, R972 (trade name, made by Nippon Aerosil Co., Ltd.) and 0.8 parts by weight of cerium oxide C having average particle sizes of 6 μm were externally added to 100 parts by weight of the toner by a Henschel mixer to obtain a magnetic toner.

Comparative Example 3

| | |
|---|---|
| Styrene-n-Butyl Acrylate Copolymer (copolymerization ratio 80:20) (Mw = 130,000, MI = 14, Tg = 59° C.) | 47 wt. parts |
| Magnetic Substance A (hexahedral magnetite, average particle sizes = 0.19 μm) | 50 wt. parts |
| Negative Charge Controlling Agent (Azo series Cr dye) | 0.7 wt. parts |
| Low-Molecular Weight Polypropylene (softening point = 148° C.) | 2.0 wt. parts |
| Low-Molecular Weight Polyethylene (softening point = 126° C.) | 0.5 wt. parts |

The powders of the above materials were mixed by a Henschel mixer and the mixture was heat-kneaded by an extruder kept at 120° C. After cooling, the kneaded mixture was roughly ground and further finely ground to provide a ground product having a 50% volume diameter $D_{50}$ of 6.6 μm. The ground product was further classified to a classified product having $D_{50}$=7.4 μm and a number distribution of the particles having particle sizes of not larger than 5 μm of 28%. In this case, the amount of the waxes on the surface of the toner was 38% by weight. By externally adding to the classified product as in Example 1, a magnetic toner was obtained.

Comparative Example 4

Using the same materials as in Example 2, the powders of the materials were mixed by a Henschel mixer and the mixture was heat-kneaded by an extruder kept at 160° C. After cooling, the kneaded mixture was roughly ground and further finely ground to provide a ground product having a 50% volume diameter $D_{50}$ of 7.8 μm. The ground product was further classified to a classified product having $D_{50}$=8.7 μm and a number distribution of the particles having particle sizes of not larger than 5 μm of 13%. In this case, the amount of the waxes on the surface of the toner was 70% by weight. By externally adding to the classified product as in Example 2, a magnetic toner was obtained.

Comparative Example 5

The kneaded product as in Example 1 was used. After cooling, the kneaded mixture was roughly ground and further finely ground to provide a ground product having a 50% volume diameter $D_{50}$ of 8.5 μm. The ground product was further classified to provide a classified product having $D_{50}$=9.3 μm and a number distribution of the particles having particle sizes of not larger than 5 μm of 8%. In this case, the amount of the waxes on the surface of the toner was 40% by weight. By externally adding 0.4 parts of colloidal silica, R972 (trade name, made by Nippon Aerosil Co., Ltd.) and 0.3 parts by weight of cerium oxide A having average particle sizes of 0.7 μm to 100 parts by weight of the toner by a Henschel mixer, a magnetic toner was obtained.

Using each of the magnetic toners obtained in Examples 1 to 4 and Comparative Examples 1 to 5 described above as magnetic one-component developer, a running test of about 5,000 copies was carried out by a printer PC-PR 1000 (manufactured by NEC Corporation) under a high temperature and a high humidity (30° C., 85% RH), the image density of copy was measured, the reproducibility of fine lines of the 1st copy only was visually evaluated, and also the developing sleeve was observed. Furthermore, using a remodelled machine (heat roll diameter: 20 mm, filler: SiC used) of the printer PC-PR 1000 (manufactured by NEC Corporation), the offset generated temperature was evaluated. Also, three A4 (210×297 $mm^2$) papers each having formed thereon an unfixed solid black image were fixed using two remodelled machines (heat roll diameter 20 mm, filler: SiC unused/used) of printers PC-PR 1000 (manufactured by NEC Corporation) kept to 180° C., thereafter, a white paper was passed through each machine, and from the strained state of the white paper, the cold offset was evaluated.

The results are shown in Table 1 below.

TABLE 1

| | (A) | (B) | (C) | (D) | (E) | (F) | (G) |
|---|---|---|---|---|---|---|---|
| Example 1 | Δ | ○ | 235° C. | 1.51 | ○ | 1.47 | ○ |
| Example 2 | Δ | ○ | >240° C. | 1.49 | ○ | 1.40 | ○ |
| Example 3 | Δ | ○ | 233° C. | 1.52 | ○ | 1.45 | ○ |
| Example 4 | Δ | ○ | 238° C. | 1.48 | ○ | 1.44 | ○ |
| Comparative Example 1 | X | ○ | 235° C. | 1.47 | ○ | 1.01 | X (*1) |
| Comparative Example 2 | X | ○ | 235° C. | 1.48 | ○ | 1.12 | X (*2) |
| Comparative Example 3 | X | ○ | 190° C. | 1.53 | ○ | 1.47 | ○ |
| Comparative Example 4 | Δ | ○ | >240° C. | 1.45 | ○ | 1.05 | X (*1) |
| Comparative Example 5 | Δ | ○ | 236° C. | 1.48 | X | 1.45 | ○ |

(A): Cold Offset (SiC unused)
(B): Cold Offset (SiC used)
(C): Hot Offset (generated temperature)
(D): Initial Density*
(E): Reproducibility of Initial Fine Line
(F): Density* after 5000 copies
(G): State of Developing Sleeve
(*): The density was measured by a densitometer, X-Rite 404 (manufactured by X-Rite Company)
(*1): Toner attaching occurred.
(*2): Many scratches formed.
"○" represents no cold offset,
"Δ" represents slight generation of cold offset by only one round of the heat roll and
"X" represents generation of cold offset on whole copied papers.

EXAMPLE 5

| | |
|---|---|
| Styrene-n-Butyl Acrylate Copolymer (copolymerization ratio 80:20) (Mw = 130,000, MI = 14, Tg = 59° C.) | 92 wt. parts |
| Negative Charge Controlling Agent | 1.0 wt. part |

-continued

| | |
|---|---|
| (Azo series Cr dye) | |
| Low-Molecular Weight Polypropylene (softening point = 148° C.) | 6.0 wt. parts |
| Low-Molecular Weight Polyethylene (softening point = 126° C.) | 1.0 wt. part |

The powders of the above materials were mixed by a Henschel mixer and the mixture was heat-kneaded by an extruder kept at 120° C. After cooling, the kneaded mixture was roughly ground and further finely ground to provide a ground product having a 50% volume diameter $D_{50}$ of 6.5 μm. The ground product was further classified to a classified product having $D_{50}$=7.3 μm and a number distribution of the particles having particle sizes of not larger than 5 μm of 30%. In this case, the surface wax amount on the toner was 48% by weight. By externally adding 1.0 part by weight of colloidal silica, R972 (trade name, made by Nippon Aerosil Co., Ltd.) and 0.5 parts by weight of cerium oxide A having average particle sizes of 0.7 μm to 100 parts by weight of the toner by a Henschel mixer, a toner was obtained.

EXAMPLE 6

| | |
|---|---|
| Polyester (bisphenol A type) (Mw = 9,000, Tg = 65° C.) | 90 wt. parts |
| Negative Charge Controlling Agent (salicylic acid series Cr dye) | 2.0 wt. parts |
| Low-Molecular Weight Polypropylene (softening point = 153° C.) | 8.0 wt. parts |

The powders of the above materials were mixed by a Henschel mixer and the mixture was heat-kneaded by an extruder kept at 110° C. After cooling, the kneaded mixture was roughly ground and further finely ground to provide a ground product having a 50% volume diameter $D_{50}$ of 7.6 μm. The ground product was further classified to a classified product having $D_{50}$=8.5 μm and a number distribution of the particles having particle sizes of not larger than 5 μm of 15%. In this case, the surface wax amount on the toner was 62% by weight. By externally adding 0.6 parts by weight of colloidal silica, R972 (trade name, made by Nippon Aerosil Co., Ltd.) and 0.5 part by weight of strontium oxide A having average particle sizes of 0.5 μm to 100 parts by weight of the toner by a Henschel mixer, a toner was obtained.

EXAMPLE 7

Using the same constituting materials as in Example 5, the powers of the materials were mixed by a Henschel mixer and the mixture was heat-kneaded by an extruder kept at 80° C. After cooling, the kneaded mixture was roughly ground and further finely ground to provide a ground product having a 50% volume diameter $D_{50}$ of 7.3 μm. The ground product was further classified to a classified product having $D_{50}$=8.0 μm and a number distribution of the particles having particle sizes of not larger than 5 μm of 18%. In this case, the surface wax amount on the toner was 35% by weight. The toners thus obtained were treated with heated air at 200° C. to produce toners having the surface wax amount on the toners being 53% by weight. By externally adding 1.0 part by weight of colloidal silica, R972 (trade name, made by Nippon Aerosil Co., Ltd.) and 0.5 parts by weight of cerium oxide A having average particle sizes of 0.7 μm to 100 parts by weight of the toner by a Henschel mixer, a toner was obtained.

EXAMPLE 8

Using the toner as used in Example 5 as a classified product and by externally adding 1.0 part by weight of colloidal silica, R972 (trade name, made by Nippon Aerosil Co., Ltd.) and 0.8 parts by weight of cerium oxide B having average particle sizes of 5 μm to 100 parts by weight of the toner by a Henschel mixer, a toner was obtained.

Comparative Example 6

Using the toner as used in Example 5 as a classified product and by externally adding 1.0 part by weight of colloidal silica, R972 (trade name, made by Nippon Aerosil Co., Ltd.) and 0.5 parts by weight of strontium oxide B having average particle sizes of 0.3 μm to 100 parts by weight of the toner by a Henschel mixer, a toner was obtained.

Comparative Example 7

Using the toner as used in Example 5 as a classified product and by externally adding 1.0 part by weight of colloidal silica, R972 (trade name, made by Nippon Aerosil Co., Ltd.) and 0.8 parts by weight of cerium oxide C having average particle sizes of 6 μm to 100 parts by weight of the toner by a Henschel mixer, a toner was obtained.

Comparative Example 8

| | |
|---|---|
| Styrene-n-Butyl Acrylate Copolymer (copolymerization ratio 80:20) (Mw = 130,000, MI = 14, Tg = 59° C.) | 94.5 wt. parts |
| Negative Charge Controlling Agent (Azo series Cr dye) | 1.0 wt. part |
| Low-Molecular Weight Polypropylene (softening point = 148° C.) | 4.0 wt. parts |
| Low-Molecular Weight Polyethylene (softening point = 126° C.) | 0.6 wt. parts |

The powders of the above materials were mixed by a Henschel mixer and the mixture was heat-kneaded by an extruder kept at 120° C. After cooling, the kneaded mixture was roughly ground and further finely ground to provide a ground product having a 50% volume diameter $D_{50}$ of 6.6 μm. The ground product was further classified to a classified product having $D_{50}$=7.4 μm and a number distribution of the particles having particle sizes of not larger than 5 μm of 28%. In this case, the surface wax amount on the toner was 30% by weight. By externally adding to the classified product as in Example 5, a toner was obtained.

Comparative Example 9

Using the same materials as in Example 6, the powders of the materials were mixed by a Henschel mixer and the mixture was heat-kneaded by an extruder kept at 160° C. After cooling, the kneaded mixture was roughly ground and further finely ground to provide a ground product having a 50% volume diameter $D_{50}$ of 7.8 μm. The ground product was further classified to a classified product having $D_{50}$=8.7 μm and a number distribution of the particles having particle sizes of not larger than 5 μm of 13%. In this case, the surface wax amount on the toner was 75% by weight. By externally adding to the classified product as in Example 6, a toner was obtained.

Each of the toners obtained in Examples 5 to 8 and Comparative Examples 6 to 9 described above was used for a two-component developer and the images formed were evaluated. The carrier used in this case and the compounding amounts were as follows.

(Production Method of Carrier)

Ferrite cores (having particle sizes of 80 μm) containing amorphous, flat, and spherical Cu—Zn were coated with a vinylidene fluoride-hexafluoropropylene copolymer (80/20). That is, 80% by weight the foregoing copolymer was added to the cores using dimethyl formamide as the solvent and coated on the cores (the coated amount: 3% by weight). The cores thus coated were dried at 130° C. to provide a carrier.

By mixing 97 parts by weight of the foregoing carrier and 3 parts by weight of each toner described above by a V-bender, each two-component developer was prepared.

A running test of about 5,000 copies was carried out under a high temperature and a high humidity using each of the developers by a remodelled machine of a copying machine, Able 3301a (manufactured by Fuji Xerox Co., Ltd.), an image density was measured, and by observing the carrier, the offset generated temperature was evaluated.

The results are shown in Table 2 below.

TABLE 2

| | [A] | [B] | [C] | [D] | [E] | [F] |
|---|---|---|---|---|---|---|
| Example 5 | Δ | ○ | 238° C. | 1.47 | 1.45 | ○ |
| Example 6 | Δ | ○ | >240° C. | 1.46 | 1.43 | ○ |
| Example 7 | Δ | ○ | 240° C. | 1.49 | 1.47 | ○ |
| Example 8 | Δ | ○ | 240° C. | 1.51 | 1.47 | ○ |
| Comparative Example 6 | X | ○ | 237° C. | 1.45 | 1.05 | X (*1) |
| Comparative Example 7 | X | ○ | 238° C. | 1.45 | 0.71 | X (*2) |
| Comparative Example 8 | X | ○ | 192° C. | 1.52 | 1.50 | ○ |
| Comparative Example 9 | Δ | ○ | >240° C. | 1.51 | 0.58 | X (*1) |

[A]: Cold Offset (SiC unused)
[B]: Cold Offset (SiC used)
[C]: Hot Offset (generated temperature)
[D]: Initial Density*
[E]: Density* after 5000 copies
[F]: Carrier State
(*): The density was measured by a densitometer, X-Rite 404 (manufactured by X-Rite Company)
(*1): Toner impaction
(*2): Coating greatly released.
"○" represents no cold offset,
"Δ" represents slight generation of cold offset by only one round of the heat roll and
"X" represents generation of cold offset on whole copied papers.

As is apparent from the above results shown in Table 1 and Table 2, incorporation of SiC in the heat roll provides an increase of thermal conductivity to result in causing no cold offset. When the exposed amount of the wax on the surface is too low, out of the range of the present invention, the resistivity against hot offset property is lowered, and when the exposed amount of the wax on the surface is too high, out of the range of the present invention, stain on a sleeve and/or carrier and lowering of density with elapse of time occur. As is apparent from the results of the running test, smaller size of fine particle diameter of the abrasive also causes stain on a sleeve and/or carrier, and larger size of fine particle diameter of abrasive provides too high abrasion property and thus damages the surface of the sleeve and/or carrier to cause lowering of density.

According to the present invention, by employing a toner composition wherein the exposed amount of the wax(es) on the surface of the toner and the particle sizes of the abrasive fine particles are specified, filming of a developing sleeve and a photoreceptor with the wax(es) can be prevented, the occurrence of an offset phenomenon can be prevented, and the stability of the development with the passage of time becomes excellent. In the case of the two-component toner, there occurs no stain by the carrier.

Also, in the image-forming process of this invention, images excellent in the dot reproducibility, the fine line reproducibility, and gradation can be formed, digital latent images can be faithfully reproduced, and the fixing latitude can be widened.

What is claimed is:

1. An electrostatic charge developing toner composition comprising (i) toner particles containing a low-molecular weight polypropylene wax and a low-molecular weight polyethylene wax, each having a softening point of 90° to 160° C., having a volume average particle size of from 4 to 9 μm, and having an exposed amount of the wax (X% by weight) on the surface thereof in the range of 40% by weight≦X≦65% by weight, and (ii) abrasive fine particles having an average particle size of from 0.5 to 5.5 μm.

2. The electrostatic charge developing toner composition of claim 1, wherein the toner particles are magnetic toner particles.

3. The electrostatic charge developing toner composition of claim 2, wherein the magnetic toner particles contain from 30 to 70% by weight of a magnetic fine powder.

4. The electrostatic charge developing toner composition of claim 1, wherein the abrasive fine particles are an inorganic fine powder having a Moh's hardness of 3 or more.

5. The electrostatic charge developing toner composition of claim 1, wherein inorganic fine particles are added as an external additive, in addition to the abrasive fine particles disclosed in claim 1.

6. The electrostatic charge developing toner composition of claim 1, wherein said toner composition is further mixed with a carrier.

7. The electrostatic charge developing toner composition of claim 6, wherein said carrier is a dispersed magnetic powder carrier containing a binder resin and a magnetic powder, or a carrier having a resin coating on a surface of a magnetic core.

8. An image-forming process comprising a step of forming electrostatic latent images on a latent image holder, a step of developing the electrostatic latent images with a developer, a step of transferring the toner images formed onto a transfer member, and a step of heat-fixing the toner images on the transfer member, wherein a toner composition comprising toner particles containing a low-molecular weight polypropylene wax and a low-molecular weight polyethylene wax, each having a softening point of 90° to 160° C., having a volume average particle size of from 4 to 9 μm, and having an exposed amount of the wax (X% by weight) on the surface of the toner in the range of 40% by weight≦X≦65% by weight, and abrasive fine particles having an average particle size of from 0.5 to 5.5 μm is used as the developer.

9. The image-forming process of claim 8, wherein in the step of heat-fixing, a heat roll having a diameter of from 5 to 30 mm is used.

10. The image-forming process of claim 9, wherein the heat roll has a layer containing a filler.

11. The image-forming process of claim 10, wherein the filler is at least one compound selected from the group consisting of silicon carbide, copper oxide and aluminum oxide.

* * * * *